US010857055B2

(12) United States Patent
Bochner

(10) Patent No.: US 10,857,055 B2
(45) Date of Patent: Dec. 8, 2020

(54) PORTABLE DEVICE FOR FACILITATING MEDICAL EXAMINATION

(71) Applicant: Gwenventions, LLC, East Brunswick, NJ (US)

(72) Inventor: Ronnie Z. Bochner, New York, NY (US)

(73) Assignee: Gwenventions, LLC, New York, NY (US)

( * ) Notice: Subject to any disclaimer, the term of this patent is extended or adjusted under 35 U.S.C. 154(b) by 827 days.

(21) Appl. No.: 15/495,156

(22) Filed: Apr. 24, 2017

(65) Prior Publication Data

US 2017/0224570 A1 Aug. 10, 2017

Related U.S. Application Data

(63) Continuation of application No. 14/689,239, filed on Apr. 17, 2015, now Pat. No. 9,629,772.

(51) Int. Cl.

| | |
|---|---|
| ***A61G 13/12*** | (2006.01) |
| ***A61G 13/08*** | (2006.01) |
| ***A61G 13/00*** | (2006.01) |
| ***A61G 13/10*** | (2006.01) |

(52) U.S. Cl.

CPC ..... *A61G 13/1245* (2013.01); *A61G 13/0009* (2013.01); *A61G 13/0018* (2013.01); *A61G 13/08* (2013.01); *A61G 13/105* (2013.01); *A61G 13/125* (2013.01)

(58) Field of Classification Search

CPC ..... A61G 13/0009; A61G 13/0018; A61G 13/08; A61G 13/105; A61G 13/1245; A61G 13/125; A61G 7/0755; A47C 20/021

See application file for complete search history.

(56) References Cited

U.S. PATENT DOCUMENTS

| | | | |
|---|---|---|---|
| 540,939 | A | 6/1895 | Barton |
| 658,999 | A | 10/1900 | Scannel |
| 724,125 | A | 3/1903 | Prindle |
| 804,089 | A | 11/1905 | Blanc |
| 1,409,330 | A | 3/1922 | Aper |
| 1,568,498 | A | 1/1926 | Caliver |
| 1,694,172 | A | 12/1928 | Gallowitz |
| 1,749,867 | A | 3/1930 | Allison |

(Continued)

FOREIGN PATENT DOCUMENTS

| | | | |
|---|---|---|---|
| DE | 3015644 | 10/1981 | |
| DE | 4221790 A1 * | 3/1993 | ..... A61G 13/009 |

(Continued)

*Primary Examiner* — Nicholas F Polito

(74) *Attorney, Agent, or Firm* — Lewis Roca Rothgerber Christie; Ralph W. Selitto, Jr.; John K. Kim

(57) ABSTRACT

A medical examination device is provided with a pair of foot support assemblies, a patient support mat, and a U-shaped support frame with an attached pair of legs. Wheel assemblies are attached to the legs and facilitate the transportation of the device to and from a bed whereby the support assemblies, patient support mat, and legs are extended and adjusted to support a patient on the bed to facilitate a medical examination. The foot support assemblies are foldable, and the patient support mat and legs are collapsible so that the device is transported and stored in a small, compact size.

11 Claims, 6 Drawing Sheets

(56) References Cited

U.S. PATENT DOCUMENTS

| | | | | |
|---|---|---|---|---|
| 1,943,282 | A * | 1/1934 | Bellavia | A47B 17/036 312/222 |
| 2,596,250 | A | 5/1952 | Klingler | |
| 2,678,461 | A | 5/1954 | Stanley | |
| 2,679,445 | A | 5/1954 | Roehm | |
| 2,692,812 | A | 10/1954 | Stahl | |
| 2,804,363 | A * | 8/1957 | Spielberg | A61G 13/12 5/624 |
| 2,963,332 | A | 12/1960 | Breuning | |
| 3,016,275 | A | 1/1962 | Grant | |
| 3,037,786 | A | 6/1962 | Shackel | |
| 3,085,842 | A | 4/1963 | Johnson | |
| 3,334,951 | A | 8/1967 | Douglass, Jr. et al. | |
| 3,428,383 | A | 2/1969 | Nobel | |
| 3,715,148 | A | 2/1973 | Beals | |
| 3,745,996 | A * | 7/1973 | Rush, Sr. | A61B 6/04 602/39 |
| 3,768,971 | A | 10/1973 | Fishpaw | |
| 3,908,562 | A | 9/1975 | Wittschen | |
| 3,966,286 | A | 6/1976 | Groseclose | |
| 4,114,965 | A | 9/1978 | Oye et al. | |
| D250,584 | S | 12/1978 | Dye | |
| 4,139,917 | A | 2/1979 | Fenwick | |
| 4,180,062 | A | 12/1979 | Alberti et al. | |
| 4,239,200 | A | 12/1980 | Sarrafian et al. | |
| D263,995 | S | 4/1982 | Steele | |
| 4,527,555 | A | 7/1985 | Ruf | |
| 4,529,185 | A | 7/1985 | Gutierres | |
| 4,584,731 | A | 4/1986 | Carter | |
| D295,156 | S | 4/1988 | Olsson | |
| 4,736,998 | A | 4/1988 | Wilson et al. | |
| 4,790,610 | A | 12/1988 | Welch et al. | |
| D304,075 | S | 10/1989 | Welch et al. | |
| 4,913,413 | A | 4/1990 | Raab | |
| D311,509 | S | 10/1990 | Failor et al. | |
| D332,855 | S | 1/1993 | Royse et al. | |
| 5,184,601 | A | 2/1993 | Putman | |
| 5,299,338 | A | 4/1994 | Foster | |
| 5,389,062 | A | 2/1995 | Mitchum, Jr. | |
| 5,399,007 | A | 3/1995 | Marconet | |
| 5,405,587 | A | 4/1995 | Fernandez et al. | |
| 5,518,310 | A | 5/1996 | Ellman et al. | |
| 5,539,941 | A | 7/1996 | Fuller | |
| 5,547,270 | A | 8/1996 | Dang | |
| 5,564,803 | A | 10/1996 | McDonald et al. | |
| 5,662,396 | A | 9/1997 | Reeder et al. | |
| 5,702,115 | A | 12/1997 | Pool | |
| D409,120 | S | 5/1999 | Aughpin | |
| D414,143 | S | 9/1999 | Brotherston | |
| D418,779 | S | 1/2000 | Greaves et al. | |
| 6,022,088 | A | 2/2000 | Metzler | |
| D430,078 | S | 8/2000 | Ellis et al. | |
| 6,108,841 | A | 8/2000 | Cameron et al. | |
| 6,256,817 | B1 | 7/2001 | McGuire et al. | |
| 6,298,854 | B1 | 10/2001 | Sundstrom | |
| D454,319 | S | 3/2002 | Ito | |
| D456,751 | S | 5/2002 | Williams | |
| 6,435,186 | B1 | 8/2002 | Klemm | |
| D463,563 | S | 9/2002 | Schoenig et al. | |
| 6,619,768 | B1 | 9/2003 | Northrup | |
| 6,663,202 | B2 | 12/2003 | Spann | |
| 6,689,029 | B2 | 2/2004 | Wakeman | |
| D498,184 | S | 11/2004 | Gustafsson | |
| D498,712 | S | 11/2004 | Jamison et al. | |
| D504,848 | S | 5/2005 | Freeborn et al. | |
| D512,149 | S | 11/2005 | Bochner et al. | |
| D519,064 | S | 4/2006 | Schrand et al. | |
| 7,024,711 | B1 | 4/2006 | Stasney et al. | |
| D522,143 | S | 5/2006 | Cartwright | |
| D540,949 | S | 4/2007 | Sundstrom | |
| D550,361 | S | 9/2007 | Cartwright | |
| D554,261 | S | 10/2007 | Meoli | |
| 7,275,796 | B2 | 10/2007 | Bochner et al. | |
| 7,311,657 | B2 | 12/2007 | Boone | |
| D602,404 | S | 10/2009 | Cusack | |
| 7,694,684 | B2 | 4/2010 | Bochner et al. | |
| D615,207 | S | 5/2010 | Bochner et al. | |
| 7,849,859 | B2 | 12/2010 | Bochner et al. | |
| 8,332,977 | B2 | 12/2012 | Bochner et al. | |
| 8,510,882 | B2 | 8/2013 | Campagna et al. | |
| 8,950,344 | B2 * | 2/2015 | Lewis | A61G 13/101 108/179 |
| 9,629,772 | B2 * | 4/2017 | Bochner | A61G 13/1245 |
| 2004/0160147 | A1 * | 8/2004 | Bochner | A61B 50/10 312/209 |
| 2006/0191072 | A1 | 8/2006 | Hempker | |
| 2007/0035217 | A1 | 2/2007 | Bochner et al. | |
| 2009/0179533 | A1 | 7/2009 | Bochner | |
| 2009/0235457 | A1 * | 9/2009 | Harvey | A61G 13/0009 5/624 |
| 2010/0242181 | A1 * | 9/2010 | Bochner | A61G 7/075 5/649 |
| 2011/0306901 | A1 | 12/2011 | Gilley et al. | |
| 2012/0304383 | A1 | 12/2012 | Marugg | |
| 2013/0318717 | A1 * | 12/2013 | Iheoma | A61G 13/00 5/600 |
| 2014/0082835 | A1 | 3/2014 | Husslage | |
| 2014/0261099 | A1 | 9/2014 | Lewis | |

FOREIGN PATENT DOCUMENTS

| | | | |
|---|---|---|---|
| GB | 403503 | 12/1933 | |
| WO | WO-8000655 A1 * | 4/1980 | A61B 5/4362 |
| WO | 2004071366 | 8/2004 | |

* cited by examiner

PORTABLE DEVICE FOR FACILITATING MEDICAL EXAMINATION

CROSS-REFERENCE TO RELATED APPLICATION

The present application is a continuation of U.S. patent application Ser. No. 14/689,239, now U.S. Pat. No. 9,629,772, filed Apr. 17, 2015.

TECHNICAL FIELD OF THE INVENTION

The present invention relates to medical examination devices and, more particularly, to a collapsible bedside medical examination device.

BACKGROUND ART

Medical practitioners regularly utilize stationary medical examination tables especially adapted to support a patient to facilitate a medical examination (e.g., a gynecological examination). Moveable bedside medical examination tables have been developed for facilitating medical examinations of patients that may be bed-bound or are unable to position themselves on stationary medical examination tables. As such moveable tables are often expensive and large in size, an inexpensive device to facilitate a medical examination for a bed-bound patient that is collapsible and compact in size is desirable.

SUMMARY OF THE INVENTION

The present invention provides a new and improved portable medical examination device for supporting one or both feet of a patient during the performance of the medical examination. Because of its mobility, the portable device can be placed adjacent a patient's bed for facilitating a bedside medical examination.

The device includes a U-shaped frame structure having a first transverse member with first and second ends, a first side member extending outwardly from the first end, and a second side member extending outwardly from the second end. The U-shaped frame structure also includes a second transverse member with third and fourth ends, a third side member extending outwardly from said third end, and a fourth side member extending outwardly from said fourth end. Two vertical members extend between the first and second transverse members, and two additional vertical members extend between the respective side members, distal the transverse members. First and second legs are telescopically attached to two of the vertical members of the U-shaped frame structure such that each of the first and second legs is adjustably movable.

A support mat is pivotally attached to the first transverse member of the U-shaped frame structure, and is pivotable between an extended position, in which the support mat extends in a substantially horizontal direction, and a folded position, in which the support mat extends substantially parallel to the vertical members of the U-shaped frame structure. The support mat is sized and shaped so as to support a patient thereon while in its extended position during the performance of a medical examination. The device further includes first and second foot support assemblies pivotally attached to the additional vertical members of the U-shaped frame structure that are distal the transverse members.

Each of the first and second foot support assemblies is pivotable between a folded (i.e., closed) position, in which each of the first and second foot support assemblies is substantially parallel with and proximate the first and second transverse members, and an unfolded (i.e., open) position, in which each of the first and second foot support assemblies extends away from the first and second transverse members.

The first foot support assembly includes a first upper member pivotally attached to the U-shaped frame, a first lower member pivotally attached to the U-shaped frame, a vertical member attached to the first upper and lower members, a first leg support overlying the first upper member, and a leg telescopically attached to the vertical member such that the leg is adjustably movable. The second foot support includes a second upper member pivotally attached to the U-shaped frame, a second lower member pivotally attached to the U-shaped frame, a vertical member attached to the second upper and lower members, a second leg support overlying the first upper member, and a leg having telescopically attached to the vertical member such that the leg is adjustably movable.

BRIEF DESCRIPTION OF THE DRAWINGS

For a more complete understanding of the present invention, reference is made to the following detailed description of an exemplary embodiment of the present invention considered in conjunction with the accompanying drawings, in which.

DETAILED DESCRIPTION OF THE INVENTION

Figures 1, 1A:
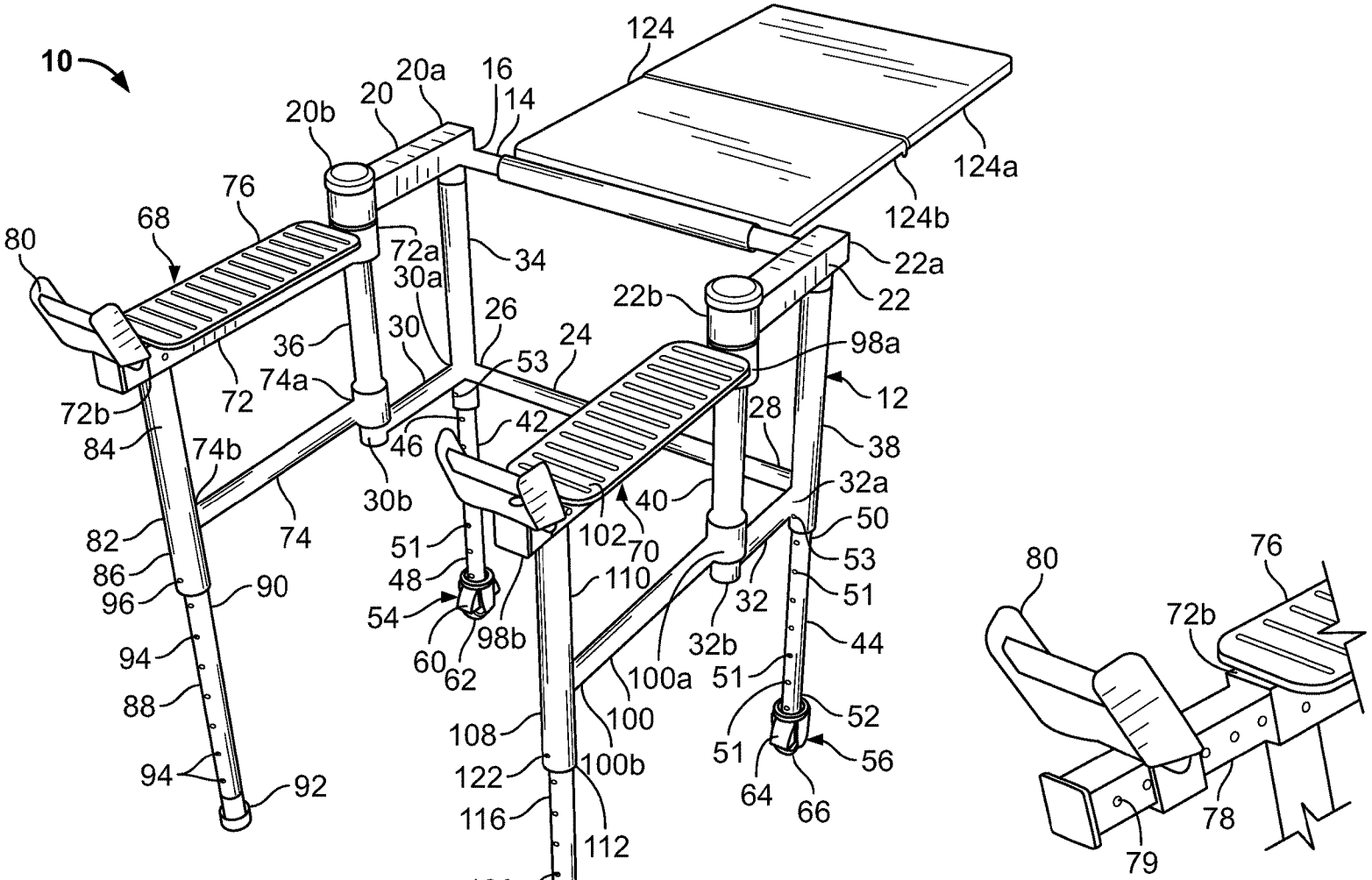
FIG. 1 is a front perspective view of a medical examination device constructed in accordance with an embodiment of the present invention.
FIG. 1A is a detailed/enlarged perspective view of a foot support assembly and stirrup of the medical examination device shown in FIG. 1.
Figure 3:
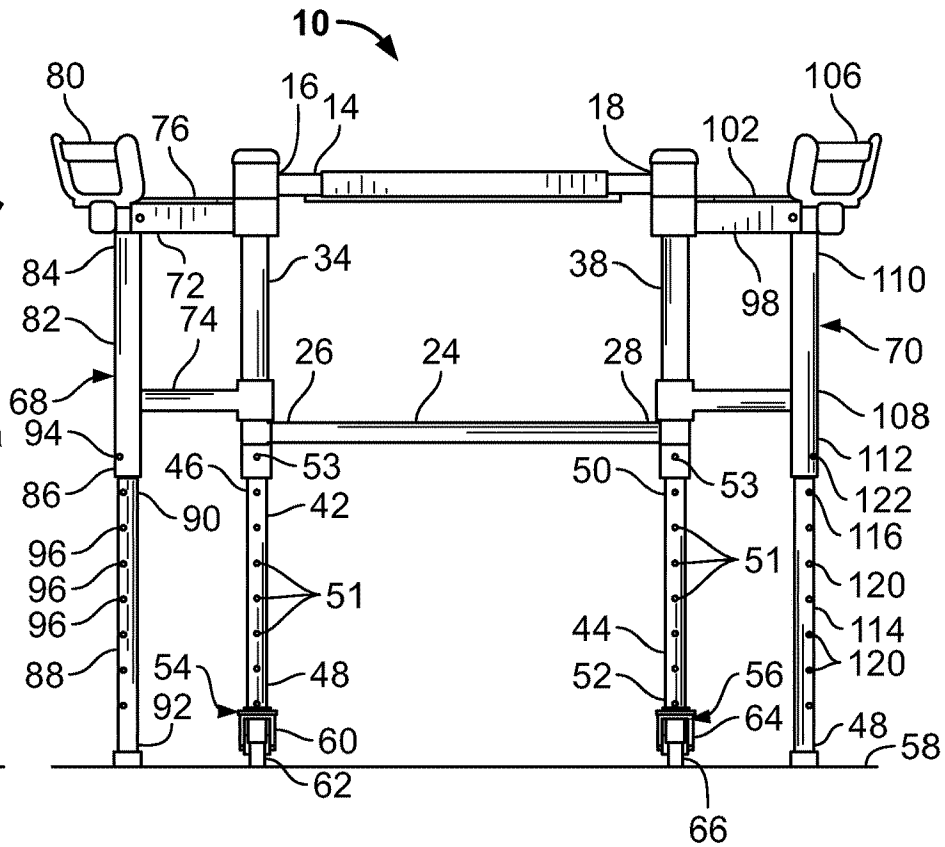
FIG. 3 is a front view of the medical examination device shown in FIG. 1 in its open (i.e., unfolded) position.
Figure 2:
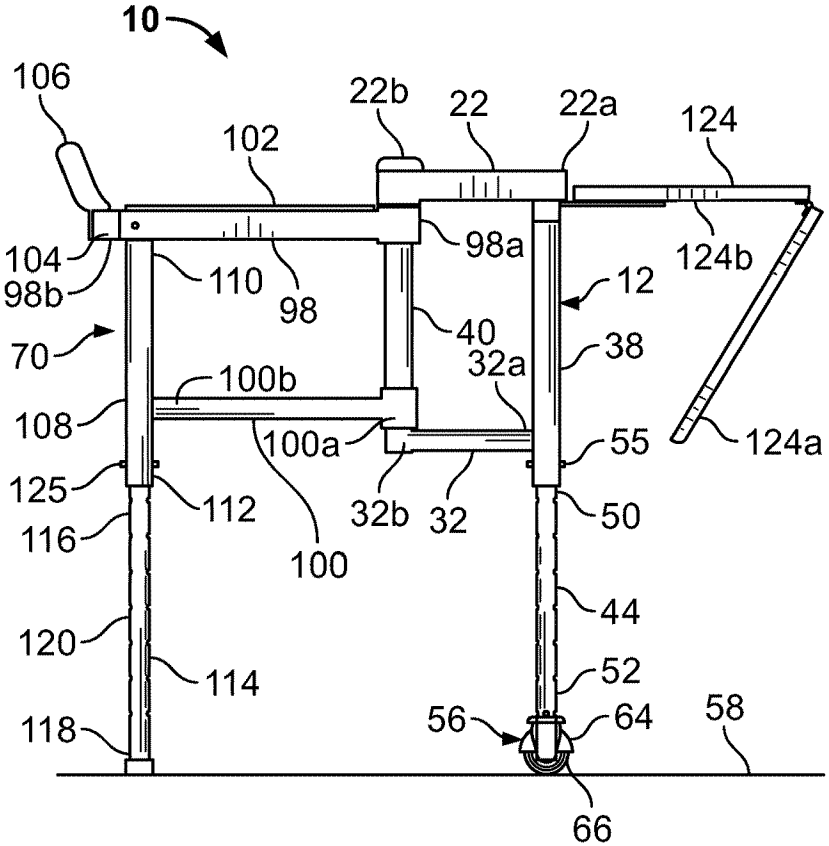
FIG. 2 is a side view of the medical examination device shown in FIG. 1, as illustrated in its open (i.e., unfolded) position.
Figure 5:
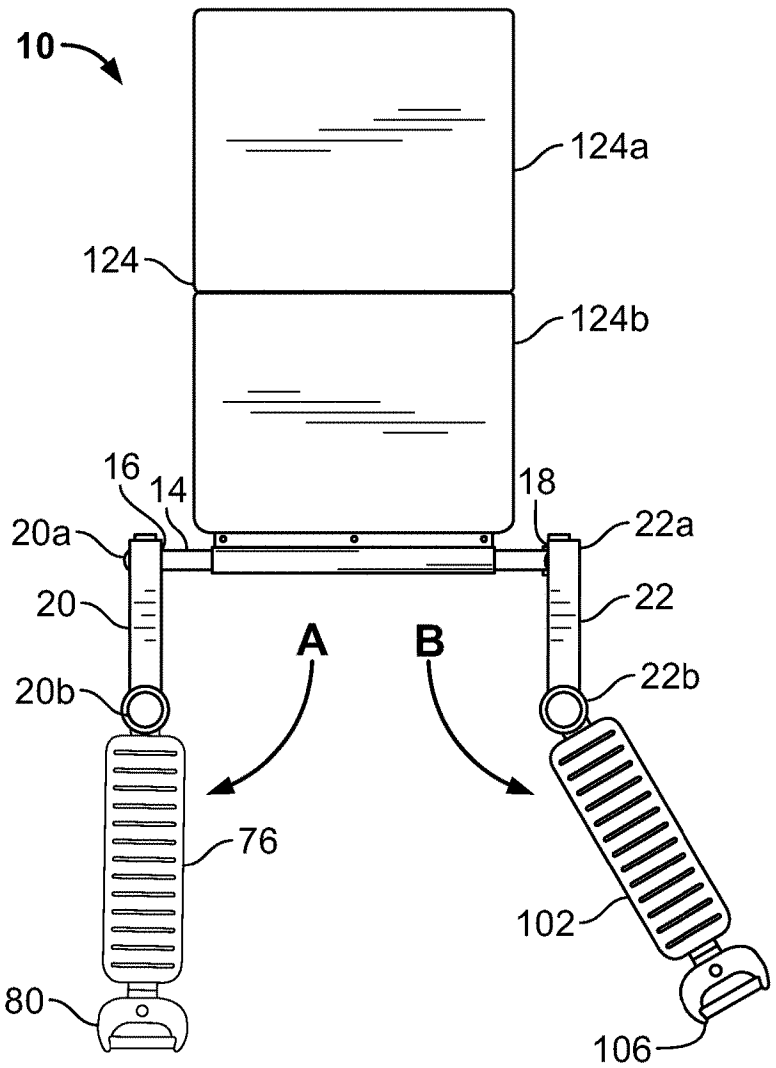
FIG. 5 is a top plan view of the medical examination device shown in FIG. 1 in its open (i.e., unfolded) position.
Figure 4:
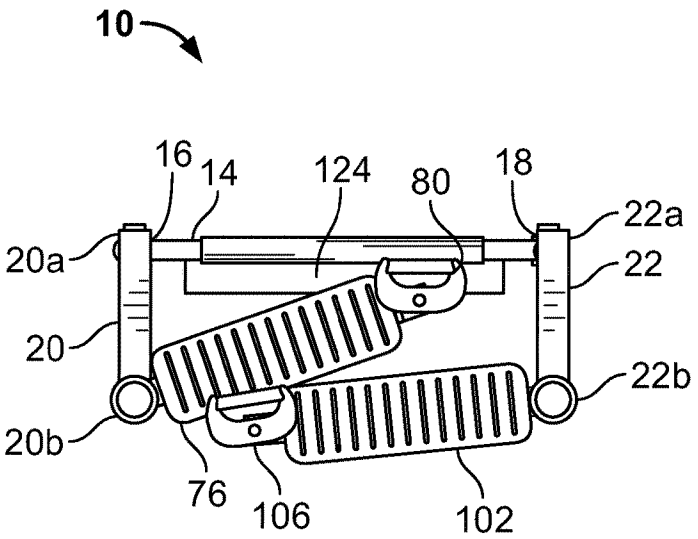
FIG. 4 is a top plan view of the medical examination device shown in FIG. 1 in its closed (i.e., folded) position.
Figure 6:
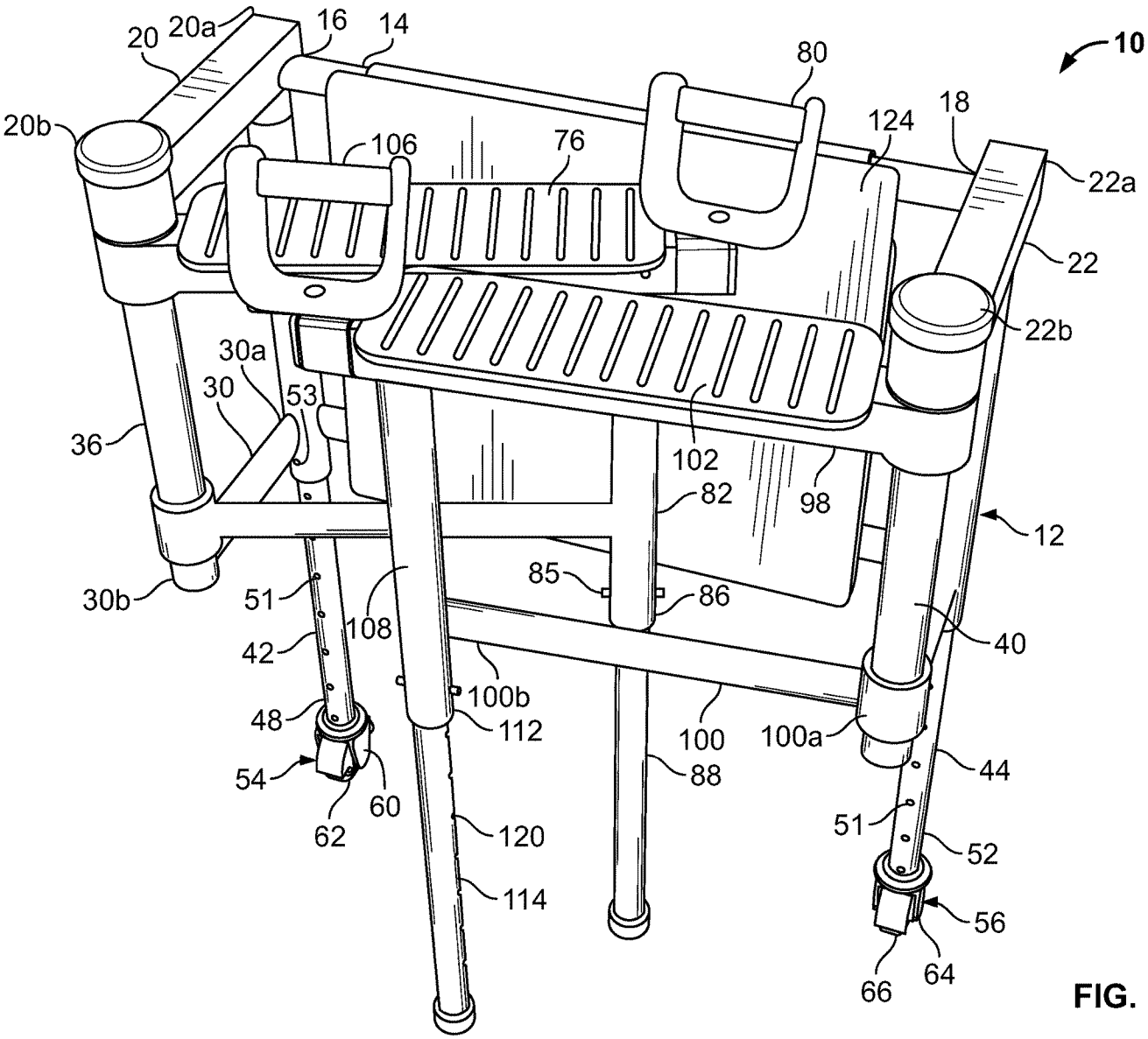
FIG. 6 is top perspective view of the medical examination device shown in FIG. 1 in its closed (i.e., folded) position.
Figure 8:
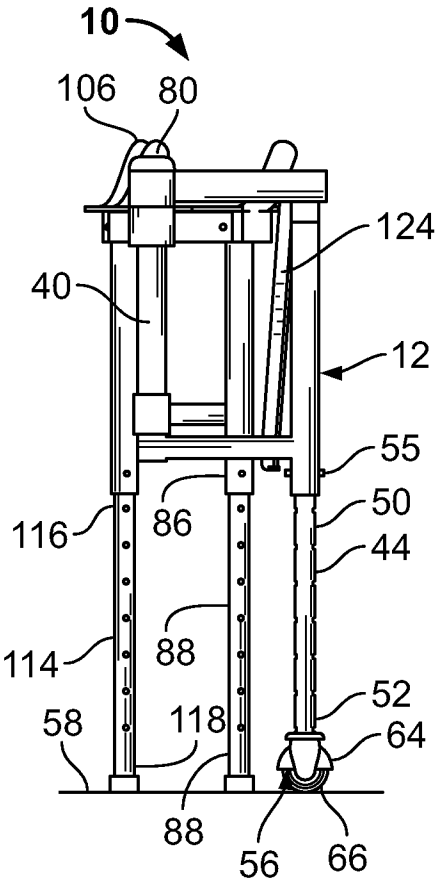
FIG. 8 is side view of the medical examination device shown in FIG. 1 in its closed (i.e., folded) position.
Figure 7:
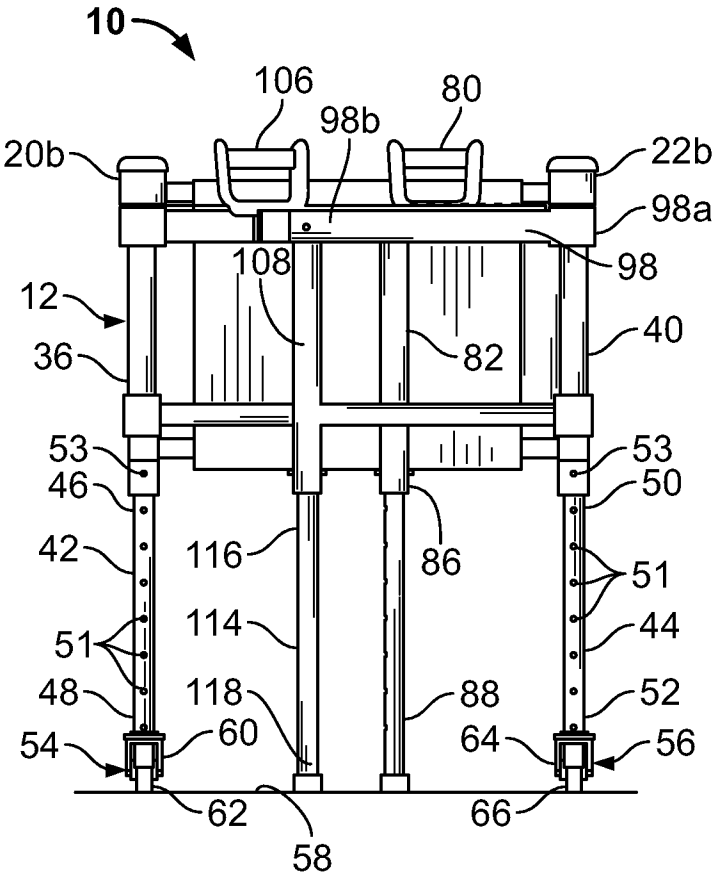
FIG. 7 is front view of the medical examination device shown in FIG. 1 in its closed (i.e., folded) position.

FIGS. 1-9 illustrate a medical examination device 10 constructed in accordance with an embodiment of the present invention. More particularly, the device 10 includes a U-shaped frame structure 12 having a first, or upper, cylindrical transverse member 14 with a first, or upper, pair of opposing ends 16, 18. A first, or upper, pair of laterally spaced side members 20, 22 extends outwardly from the ends 16, 18, respectively. The side member 20 includes a first end 20*a* proximate to the end 16 of the upper transverse member 14, and a second end 20*b* distal to the end 16 of the upper transverse member 14. Similarly, the side member 22 includes a first end 22*a* proximate to the end 18 of the upper transverse member 14, and a second end 22*b* distal to the end 18 of the upper transverse member 14.

Referring now to FIGS. 1-3 and 6-9, the U-shaped frame structure 12 also includes a second, or lower, cylindrical transverse member 24 with a second, or lower, pair of opposing ends 26, 28. A second, or lower, pair of laterally spaced side members 30, 32 extends outwardly from the ends 26, 28, respectively. The side member 30 includes a first end 30*a* proximate to the end 26 of the lower transverse member 24, and a second end 30*b* distal to the end 26 of the lower transverse member 24. Similarly, the side member 32 includes a first end 32*a* proximate to the end 28 of the lower transverse member 24, and a second end 32*b* distal to the end 28 of the lower transverse member 24.

The U-shaped frame structure 12 also includes four vertical tubular members 34, 36, 38 and 40. A first proximate vertical tubular member 34 extends between the first end 20*a* of the side member 20 and the first end 30*a* of the side member 30. A first distal vertical tubular member 36 extends between the second end 20*b* of the side member 20 and the second end 30*b* of the side member 30. A second proximate vertical tubular member 38 extends between the first end 22*a* of the side member 22 and the first end 32*a* of the side member 32. A second distal vertical tubular member 40 extends between the second end 22*b* of the side member 22 and the second end 32*b* of the side member 32.

Continuing to refer to FIGS. 1-3 and 6-9, legs 42, 44 are telescopically attached to the U-shaped frame structure 12, as further described below. The leg 42 has an upper end 46 and a lower end 48, and the leg 44 has an upper end 50 and a lower end 52. The legs 42, 44 are sized and shaped to slidingly (i.e., telescopically) move within the interior of the first and second proximate tubular members 34, 38 respectively (e.g., extended, as shown in FIGS. 1-3 and 6-9). The legs 42, 44 and proximate tubular members 34, 38 may include complimentary apertures 51 and 53, respectively, that constitute a suitable locking mechanism and may employ conventional fasteners (e.g., set screws or pins 55 (see FIGS. 1, 8 and 9)) to releasably lock the extended legs 42, 44 in place within the interior of the first and second proximate tubular members 34, 38 respectively.

Still referring to FIGS. 1-3 and 6-9, wheel assemblies 54, 56 are attached to the lower ends 48, 52 of the legs 42, 44, respectively, for supporting and transporting the device 10 on a surface, such as a floor 58 (see FIGS. 2, 3 and 7-9). The wheel assembly 54 has a bracket 60 that pivotally supports a wheel 62, while the wheel assembly 56 has a bracket 64 that pivotally supports a wheel 66. The bracket 60 is oriented on the lower end 48 of leg 42, and the bracket 64 is oriented on the lower end 52 of leg 44. The brackets 60, 64 are fabricated of metal or other suitable material and are rigidly fastened to the lower ends 48, 52 of legs 42, 44, respectively, by screws or other suitable fasteners.

Now referring to FIGS. 1-6, foot support assemblies 68, 70 are pivotally attached to the first and second distal vertical tubular members 36, 38 of the U-shaped frame structure 12, respectively. The foot support assembly 68 includes an upper member 72 having a first end 72*a* pivotally attached to the first distal vertical tubular member 36 at a point proximate the second end 20*b* of the side member 20, and a second end 72*b* that is distal to the first distal vertical tubular member 36. The foot support assembly 68 also includes a lower member 74 having a first end 74*a* pivotally attached to the first distal vertical tubular member 36 at a point proximate the second end 30*b* of the side member 30, and a second end 74*b* that is distal to the first distal vertical tubular member 36. A substantially flat leg support 76 overlies the upper member 72. An extendable member 78 slidably engages the second end 72*b* of the upper member 72, and a foot support (e.g., a stirrup) 80 pivotally engages the extendable member 78, as illustrated in FIG. 1*a*. The extendable member 78 has a plurality of apertures 79 into which the foot support 80 may be removeably secured (e.g., by a removeable pin (not shown)). The foot support assembly 68 also includes a vertical tubular member 82 having an upper end 84 that engages the second end 72*b* of the upper member 72, and a lower end 86. The second end 74*b* of the lower member 74 is attached to the vertical tubular member 82 at a point intermediate its upper and lower ends 84, 86.

Referring again to FIGS. 1-3 and 6-9, a leg 88 is telescopically attached to the vertical tubular member 82 of the foot support assembly 68. The leg 88 has an upper end 90 and a lower end 92, and is sized and shaped to slidingly (i.e., telescopically) move within the interior of the vertical tubular member 82. The leg 88 and lower end 86 of the vertical tubular member 82 may include complimentary apertures 94 and 96, respectively, that constitute a suitable locking mechanism and may employ conventional fasteners (e.g., set screws or pins 85 (see FIGS. 1 and 6)) to releasably lock the extended leg 88 in place within the interior of the vertical tubular member 82.

The foot support assembly 70 is basically identical, in construction and operation, to the foot support assembly 68. In such circumstances, the construction and operation of the foot support assembly 70 will be discussed briefly hereinafter without describing the details thereof.

Referring to FIGS. 1-3 and 6-9, the foot support assembly 70 includes an upper member 98 having a first end 98*a* pivotally attached to the second distal vertical tubular member 40 at a point proximate the second end 22*b* of the side member 22, and a second end 98*b* that is distal to the second distal vertical tubular member 40. The foot support assembly 70 also includes a lower member 100 having a first end 100*a* pivotally attached to the second distal vertical tubular member 40 at a point proximate the second end 32*b* of the side member 32, and a second end 100*b* that is distal to the second distal vertical tubular member 40. A substantially flat leg support 102 overlies the upper member 98. An extendable member 104 slidably engages the second end 98*b* of the upper member 98, and a foot support (e.g., a stirrup) 106 pivotally engages the extendable member 104 (see FIG. 1*a* for corresponding structures of foot support assembly 68). The foot support assembly 70 also includes a vertical tubular member 108 having an upper end 110 that engages the second end 98*b* of the upper member 98, and a lower end 112. The second end 100*b* of the lower member 100 is attached to the vertical tubular member 108 at a point intermediate its upper and lower ends 110, 112. A leg 114 is telescopically attached to the vertical tubular member 108 of the foot support assembly 70. The leg 114 has an upper end 116 and a lower end 118, and is sized and shaped to slidingly (i.e., telescopically) move within the interior of the vertical tubular member 108. The leg 114 and lower end 112 of the vertical tubular member 108 may include complimentary apertures 120 and 122, respectively, that constitute a suitable locking mechanism and may employ conventional fasteners (e.g., set screws or pins 125 (see FIGS. 2 and 9)) to releasably lock the extended leg 114 in place within the interior of the vertical tubular member 108.

With reference to FIGS. 1, 2 and 4-9, a rigid support mat 124 is pivotally attached to the upper transverse member 14 of the U-shaped frame structure 12. More particularly, the support mat 124 is sized and shaped so as to support a patient thereon during a medical examination. The support mat 124 is pivotable between an extended position, in which it extends in a substantially horizontal direction from the upper transverse member 14 (see FIGS. 1, 5 and 9), and a retracted position, in which it is oriented substantially vertically, so as to be substantially parallel to the first and second proximate vertical tubular members 34, 36 of the U-shaped frame structure 12 (see FIGS. 4 and 6-8). The rigid support mat 124 may include two foldable connected portions 124 *a* and 124 *b* (see FIGS. 1 and 5).

When the device 10 is not in use, it is stored away with the foot support assemblies 68, 70 having been rotated towards each other to their folded (i.e., closed) positions, so as to be substantially parallel with and proximate the upper transverse member 14, and the support mat 124 positioned in its retracted (i.e., substantially vertical) position (see FIGS. 4 and 6-8).

Figure 9:
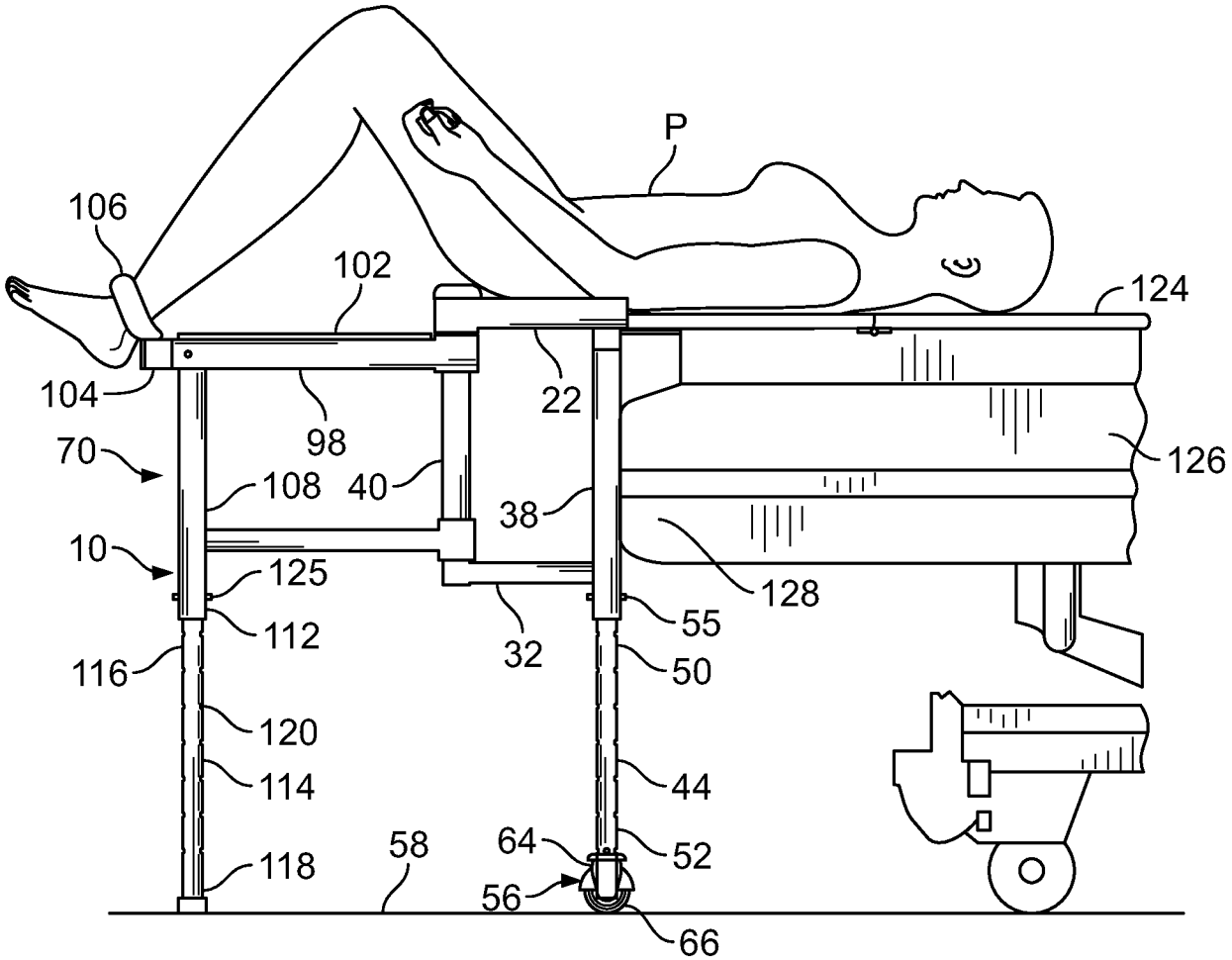
FIG. 9 is a side view of the medical examination device shown in FIG. 1 in use with a bed and a patient thereon.

Referring now to FIG. 9, in order to perform a medical examination (e.g., an obstetric/gynecological examination) with the use of the device 10 alongside a patient bed 126 (e.g., a hospital bed) having a removable foot board (not shown) at an end 128 thereof, the foot board is removed. The device 10 is then positioned against the end 128 of the bed 126. More particularly, with the support mat 124 placed and supported on the bed 126 in its extended position, the U-shaped frame structure 12 of the device 10 is positioned against the end 128 of the bed 126. Alternatively, the U-shaped frame structure 12 can be placed against either side of the bed 126 (not shown).

After properly positioning the device 10, the wheels 62, 66 are locked so as to prevent movement of the device 10 relative to the bed 126. Thereafter, the foot support assemblies 68, 70 are pivoted from their folded (i.e., closed) positions toward their unfolded (i.e., open) positions (see Arrows A and B in FIG. 5) so as to position same at desired locations. In this regard, each of the foot supports 80, 106, respectively, is secured into a selected one of the mounting holes 79 of the extendable members 78, 104, thereby securing the foot supports 80, 106 to the extendable members 78, 104, respectively.

A patient then places herself (or is placed) on the support mat 124 with her feet supported on the foot supports 80, 106 (see FIG. 9) so that a doctor (or other medical personnel) may perform a medical examination (e.g., an obstetric/gynecological examination) on the patient.

After the use of the device 10, the foot support assemblies 68, 70 are pivoted from their unfolded (i.e., open) positions to their folded (i.e., closed) positions.

It should be appreciated that the present invention provides numerous advantages over the prior art discussed above. For instance, because the device 10 is portable and/or mobile, medical examinations, such as obstetric and/or gynecological examinations, can be performed alongside patient beds (e.g., hospital beds). As a result, the device 10 is particularly suitable for performing medical examinations on bed-bound patients.

It should be noted that the present invention can have numerous modifications, variations and applications. For instance, the support mat 124 can be eliminated or replaced with other mechanisms. Moreover, the device 10 can be used in conjunction with different types of medical devices (e.g., patient examination tables, etc.). The device 10 can also be used in performing many different types of medical examinations (e.g., gastroenterology examinations). When performing a gastroenterology examination, the device 10 is preferably positioned along a side of a patient's bed. Further, the device 10 can be provided with other tools and equipment, such as retractable electrical cords, etc.

It will be understood that the embodiments described herein are merely exemplary and that a person skilled in the art may make many variations and modifications without departing from the spirit and scope of the invention. All such variations and modifications are intended to be included within the scope of the invention as defined in the appended claims.

I claim:

1. Apparatus adapted for mounting on a support surface and for facilitating a medical examination of a patient, said apparatus comprising:

a support mat extendable in a first horizontal direction along a central longitudinal axis of said apparatus;

a U-shaped frame structure including a transverse member arranged at one end of said frame structure and extending generally perpendicular to said central longitudinal axis of said apparatus, said transverse member supporting said support mat for pivotal movement about said transverse member, a first leg assembly attached to and extending from one end of said transverse member in a second horizontal direction opposite said first horizontal direction, said first leg assembly defining one side of said frame structure, and a second leg assembly attached to and extending from an opposite end of said transverse member in said second horizontal direction, said second leg assembly defining an opposite side of said frame structure which is spaced from said one side of said frame structure such that said frame structure has an open area between said first and second leg assemblies;

a third leg assembly including a first foot support assembly which is movable relative to said third leg assembly, said third leg assembly being pivotally attached to said first leg assembly such that said third leg assembly is pivotable relative to said first leg assembly in a generally horizontal direction between an extended position, in which said first foot support assembly is positioned generally parallel to said central longitudinal axis of said apparatus on said one side of said frame structure and in which said third leg assembly extends from said first leg assembly along a first laterally offset longitudinal axis of said apparatus on said one side of said frame structure, said first laterally offset longitudinal axis being generally parallel to said central longitudinal axis of said apparatus, and a folded position, in which said third leg assembly and said first foot support assembly are at least partially positioned within said open area of said frame structure between said first and second leg assemblies; and a fourth leg assembly including a second foot support assembly which is movable relative to said fourth leg assembly, said fourth leg assembly being pivotally attached to said second leg assembly such that said fourth leg assembly is pivotable relative to said second leg assembly in a generally horizontal direction between an extended position, in which said second foot support assembly is positioned generally parallel to said central longitudinal axis of said apparatus on said opposite side of said frame structure and in which said fourth leg assembly extends from said second leg assembly along a second laterally offset longitudinal axis of said apparatus on said opposite side of said frame structure, said second laterally offset longitudinal axis being generally parallel to said central longitudinal axis of said apparatus, and a folded position, in which said fourth leg assembly and said second foot support assembly are at least partially positioned within said open area of said frame structure between said first and second leg assemblies.

2. The apparatus of claim 1, wherein said first leg assembly includes a first telescopically extendable leg, said second leg assembly includes a second telescopically extendable leg, said third leg assembly includes a third telescopically extendable leg, and said fourth leg assembly includes a fourth telescopically extendable leg, said first, second, third and fourth telescopically extendable legs cooperating to support said apparatus on a support surface.

3. The apparatus of claim 2, wherein said first telescopically extendable leg of said first leg assembly includes a first wheel assembly; and wherein said second telescopically extendable leg of said second leg assembly includes a second wheel assembly, said first and second wheel assemblies cooperating to facilitate the support and transportation of said apparatus on a support surface.

4. The apparatus of claim 3, wherein said first wheel assembly includes a first bracket and a first wheel supported by said first bracket; and wherein said second wheel assembly includes a second bracket and a second wheel supported by said second bracket.

5. The apparatus of claim 2, wherein said first, second, third and fourth telescopically extendable legs are collapsible.

6. The apparatus of claim 1, wherein said support mat is pivotable about said transverse member of said frame structure between an extended position, in which said support mat extends from said transverse member in said first horizontal direction, and a retracted position, in which said support mat extends from said transverse member in a generally vertical direction, said support mat being sized and shaped so as to support a patient thereon while said support mat is in its said extended position.

7. The apparatus of claim 6, wherein said support mat includes a first portion, which is pivotally attached to said transverse member of said frame structure, and a second portion, which is foldable relative to said first portion, at least said second portion of said support mat being adapted to be placed on and supported by a patient's bed.

8. The apparatus of claim 1, wherein said third leg assembly includes a first upper member pivotally attached to said first leg assembly; and wherein said fourth leg assembly includes a second upper member pivotally attached to said second leg assembly.

9. The apparatus of claim 8, wherein said first foot support assembly includes a first substantially flat leg support overlying said first upper member of said third leg assembly and a first extendable member received within said first upper member; and wherein said second foot support assembly includes a second substantially flat leg support overlying said second upper member of said fourth leg assembly and a second extendable member received within said second upper member.

10. The apparatus of claim 9, wherein said first extendable member includes a first stirrup; and wherein said second extendable member includes a second stirrup.

11. The apparatus of claim 10, wherein said first stirrup is pivotally attached to said first extendable member; and wherein said second stirrup is pivotally attached to said second extendable member.

* * * * *